US010132110B2

(12) United States Patent
Aldersley et al.

(10) Patent No.: US 10,132,110 B2
(45) Date of Patent: Nov. 20, 2018

(54) SUPPORT DEVICE FOR A CLOSED FLAP OF A VEHICLE, IN PARTICULAR TAILGATE OF A MOTOR VEHICLE

(71) Applicant: Bayerische Motoren Werke Aktiengesellschaft, Munich (DE)

(72) Inventors: Nicholas Aldersley, Hebertshausen (DE); Alberto Escudero, Neufarn (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 257 days.

(21) Appl. No.: 14/536,874

(22) Filed: Nov. 10, 2014

(65) Prior Publication Data

US 2015/0059125 A1 Mar. 5, 2015

Related U.S. Application Data

(63) Continuation of application No. PCT/EP2013/059231, filed on May 3, 2013.

(30) Foreign Application Priority Data

May 11, 2012 (DE) ..... 10 2012 207 902

(51) Int. Cl.
*E05F 5/02* (2006.01)
*E05C 17/00* (2006.01)

(52) U.S. Cl.
CPC ..... *E05F 5/022* (2013.01); *E05C 17/025* (2013.01); *E05Y 2800/422* (2013.01);
(Continued)

(58) Field of Classification Search
CPC . Y10T 16/61; Y10T 16/625; E05Y 2800/422; E05Y 2900/546; E05F 5/022; E05C 17/025
See application file for complete search history.

(56) References Cited

U.S. PATENT DOCUMENTS 2,972,164 A * 2/1961 Nallinger ..... E05F 7/04 16/85
3,020,581 A * 2/1962 Falk ..... E05F 3/02 16/66

(Continued)

FOREIGN PATENT DOCUMENTS

DE 10 2005 012 774 A1 9/2006
DE 10 2006 061 611 A1 7/2008

(Continued)

OTHER PUBLICATIONS

International Search Report (PCT/ISA/210) dated Jul. 26, 2013, with English translation (five (5) pages).

(Continued)

*Primary Examiner* — Victor D Batson
*Assistant Examiner* — Matthew J Sullivan
(74) *Attorney, Agent, or Firm* — Crowell & Moring LLP

(57) ABSTRACT

A support for a closed flap of a vehicle, particularly a tailgate of a motor vehicle, has a bearing part arranged at the flap or at a wall area of the vehicle body adjacent to the closed flap. The bearing part can be adjusted in its position before its fastening. In its premounting position, a clamping element is frictionally or form-fittingly adjustably connected with the bearing part such that, after a fastening of the bearing part previously adjusted in its position, the clamping element can be adjusted by an applied force from the premounting position into a clamping position limited by a stop, in which the clamping element is frictionally and/or form-fittingly fixedly held at the bearing part and, at least indirectly, under a pretensioning force, rests against the flap or the wall area, when the flap is closed.

13 Claims, 3 Drawing Sheets

(52) U.S. Cl.
CPC ..... *E05Y 2900/546* (2013.01); *Y10T 16/61* (2015.01); *Y10T 16/625* (2015.01)

(56) References Cited

U.S. PATENT DOCUMENTS

| | | | | | |
|---|---|---|---|---|---|
| D291,406 | S * | 8/1987 | McNeese | D8/323 | |
| 4,932,100 | A * | 6/1990 | Flowers | E05F 7/04 | 16/82 |
| 5,937,585 | A * | 8/1999 | Tidbury | E05F 7/04 | 292/DIG. 39 |
| 6,318,795 | B1 * | 11/2001 | Pyo | B60J 5/101 | 16/82 |
| 6,676,201 | B2 * | 1/2004 | Im | B60J 5/101 | 16/82 |
| 7,014,258 | B2 * | 3/2006 | Schubring | B60J 5/10 | 292/216 |
| 7,228,595 | B2 * | 6/2007 | Tudora | E05F 5/022 | 16/86 B |
| 7,308,731 | B2 * | 12/2007 | Schubring | E05F 5/022 | 16/86 R |
| 7,393,027 | B1 * | 7/2008 | Chen | E05C 17/56 | 16/82 |
| 7,536,747 | B2 * | 5/2009 | Christeson | E05D 5/02 | 16/247 |
| 8,056,965 | B2 * | 11/2011 | Rosemann | E05F 5/022 | 16/86 A |
| 8,322,762 | B2 * | 12/2012 | Watson | E05F 7/005 | 292/342 |
| 8,387,211 | B2 * | 3/2013 | Kutschat | E05C 17/46 | 16/82 |
| 8,776,316 | B2 * | 7/2014 | McRoskey | E05F 5/02 | 16/82 |
| 8,888,170 | B2 * | 11/2014 | McCuller | E05F 5/022 | 296/193.11 |
| 8,893,351 | B2 * | 11/2014 | Payson | E05F 5/08 | 16/82 |
| 9,290,979 | B1 * | 3/2016 | Alexander | E05F 5/022 | |
| 2004/0221424 | A1 | 11/2004 | Matsuzawa et al. | | |
| 2006/0064845 | A1 * | 3/2006 | Fujii | B60R 21/34 | 16/82 |
| 2006/0097550 | A1 * | 5/2006 | Wang | E05F 5/022 | 296/207 |
| 2015/0308172 | A1 * | 10/2015 | Veino | E05D 7/1061 | 49/380 |

FOREIGN PATENT DOCUMENTS

| | | | | |
|---|---|---|---|---|
| DE | 10 2010 029 051 | A1 | 11/2011 | |
| EP | 0 892 140 | A2 | 1/1999 | |
| FR | 2885640 | A1 * | 11/2006 | E05F 5/022 |

OTHER PUBLICATIONS

German Search Report dated Jul. 26, 2012, with English translation (ten (10) pages).

* cited by examiner

SUPPORT DEVICE FOR A CLOSED FLAP OF A VEHICLE, IN PARTICULAR TAILGATE OF A MOTOR VEHICLE

CROSS REFERENCE TO RELATED APPLICATIONS

This application is a continuation of PCT International Application No. PCT/EP2013/059231, filed May 3, 2013, which claims priority under 35 U.S.C. § 119 from German Patent Application No. 10 2012 207 902.5, filed May 11, 2012, the entire disclosures of which are herein expressly incorporated by reference.

BACKGROUND AND SUMMARY OF THE INVENTION

The invention relates to a supporting device for a closed flap of a vehicle, particularly a tailgate of a motor vehicle, having a bearing part arranged at the flap or at a wall area of the vehicle body adjacent to the closed flap, which bearing part can be adjusted in its position before its fastening.

In European Patent Document EP 0 892 140 A1, such a supporting device forms a stop buffer, particularly for a hood- or hatch-type body part of a vehicle. So that the axial position of the buffer head of the stop buffer as well as a pretensioning will be easy to adjust, the stop buffer has a device for the self-adaptation of the buffer head and a fixing device for the subsequent fixing of the buffer head. The device for the self-adaptation has, for example, an expansion sleeve which, when it is not expanded, during the closing of the hood- or hatch-type vehicle body part, permits an automatic axial adjusting of the buffer head. For the subsequent axial fixing of the buffer head, the expansion sleeve is expanded by way of an axially screwed-in screw. A pretensioning between the buffer head and the hood- or hatch-type vehicle body part is achieved by way of a stop part with a thickness corresponding to the desired pretensioning, which stop part, after the axial adjusting of the buffer head, is connected either with the buffer head or with a component arranged opposite the buffer head. During the mounting of the stop part by a worker, the stop part would have to be gripped by one hand and have to be guided in a position that is as precise as possible to a mounting opening. Probably, the worker would then have to use his other hand and possibly a tool for bringing the stop part into an installation position, which is limited by a stop, into the mounting opening. During this mounting operation, the buffer head and its fastening element as well as the stop part then have to be guided in a coordinated manner to the mounting site and be made available to a worker who would then need both hands for the mounting of the stop buffer. The expansion sleeve, the buffer head and/or the stop part cannot be mounted (or not immediately be mounted), possibly because of component tolerances, whereby troublesome delays could occur in the mounting process.

It is an object of the invention to provide a supporting device for a closed flap of a vehicle, particularly a tailgate of a motor vehicle, which permits an easy manual or automated mounting as well as a versatile use of the supporting device.

This and other objects are achieved according to the invention by a supporting device for a closed flap of a vehicle. The supporting part has a bearing part at the flap or at a wall area of the vehicle body adjacent to the closed flap, which bearing part can be adjusted in its position before its fastening. In a premounting position, a clamping element is frictionally or form-fittingly adjustably connected with the bearing part such that, after the fastening of the bearing part previously adjusted in its position, the clamping element can be adjusted by an applied force from the premounting position into a clamping position limited by a stop. In the clamping position, the clamping element is frictionally and/or form-fittingly held at the bearing part and, at least indirectly, under a pretensioning force, rests against the flap or the wall area.

After the clamping element has already been connected with the bearing part in a premounting position, these parts can be premounted, for example as a constructional unit, on the vehicle or at a premounting site, and do not have to be provided individually for a final mounting. During the closing of the flap, which may, for example, be a door or a hood or rear hatch of a vehicle, particularly of a motor vehicle, the bearing part is adjusted into its final mounting position and the clamping element is adjusted into a predefined premounting position, in which, after a fastening of the bearing part, the clamping element only has to be adjusted by sufficient applied force into a final clamping position limited by a stop. When access is sufficient, the application of force can take place while the flap is closed or after the opening of the flap. K in the latter case, the bearing part is loaded by a pretensioned spring element into such a position that, during the closing, the flap can adjust the bearing part against the pretensioning force of the spring element into the final mounting position, it only has to be ensured that, during the subsequent opening of the flap, when the bearing part has not yet been fastened, the bearing part cannot be automatically adjusted by the pretensioning force of the spring element back into a position that relaxes the spring element. This can, for example, be prevented by way of a simple frictionally and/or form-fittingly acting detent device. The bearing part can, for example, be detachably fastened to a supporting element fixedly or detachably connected with the vehicle body and can be adjusted in its position in at least one direction before a fastening. In this case, the spring element can, for example, in each case, support itself at least indirectly, on one side at the supporting element and on the other side at the bearing part.

A mounting of the supporting device can be manually or automatically or mechanically assisted. The mounting expenditures for the supporting device are low and simplified, so that malfunctions should not or should rarely occur. The supporting device can be used for lateral support without play as well as for support without play in the closing direction of the respective closed flap.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
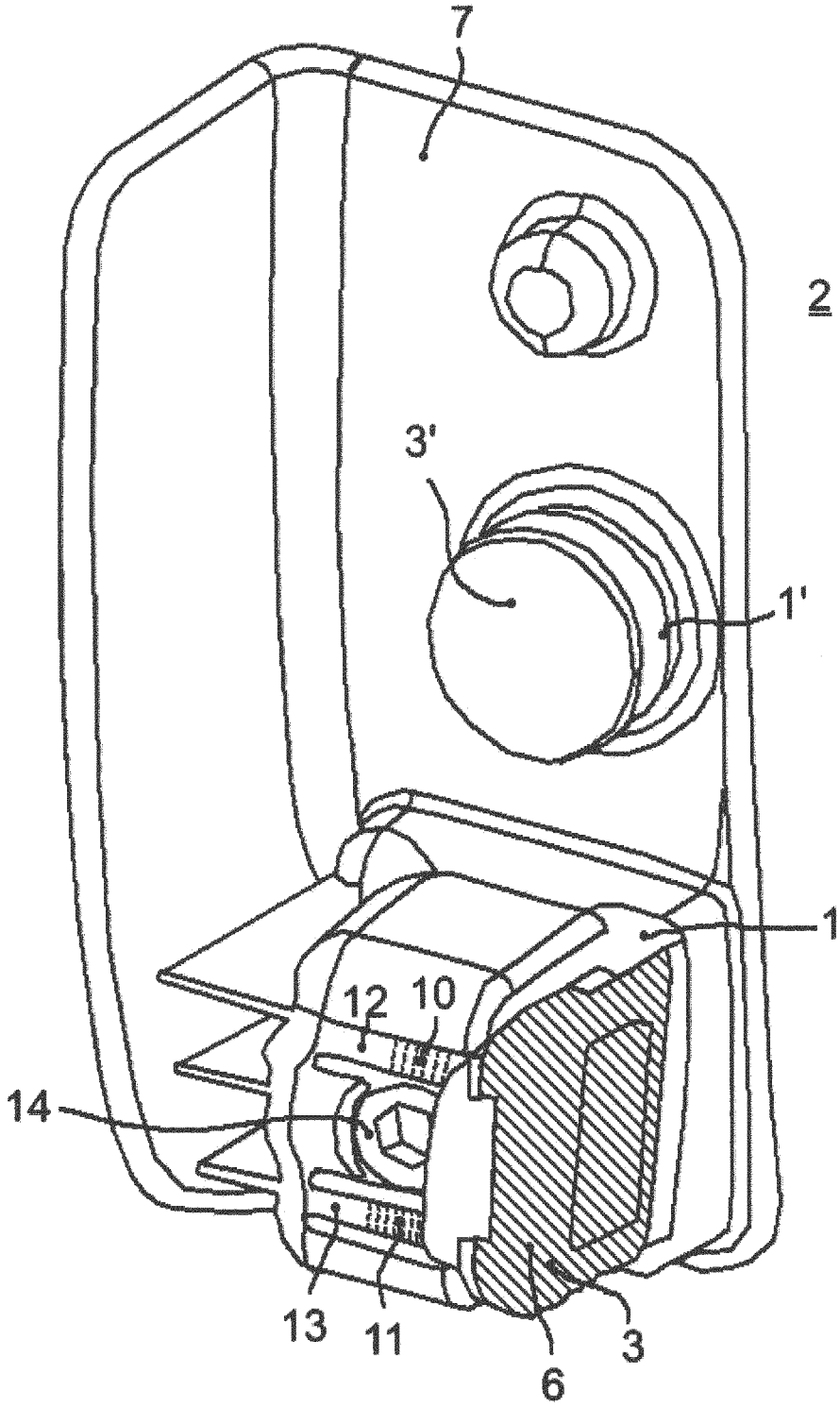
FIG. 1 is a simplified perspective view of a supporting device for a closed, not shown, tailgate of a motor vehicle.

FIG. 1 is a simplified illustration of a supporting device for a closed, not illustrated tailgate of a motor vehicle, which supporting device has a bearing part 1 which is arranged on a wall area 2 of the motor vehicle body adjacent to the closed tailgate. The position of the bearing part 1 can be adjusted before its fastening. A clamping element 3 illustrated in its premounting position is frictionally and/form-fittingly adjustably connected with the bearing part 1 such that, after a fastening of the bearing part 1 previously adjusted in its position, the clamping element 3 can be adjusted by applied force from the premounting position into a clamping position limited by a stop, in which the clamping element 3 is held in a frictional and/or formfitting manner at the bearing part and, when the tailgate is closed, rests at least indirectly under a pretensioning force, laterally against the tailgate.

In the embodiment, the clamping element 3 can be adjusted by way of a guiding device (not shown) approximately in the closing direction of the tailgate with respect to the bearing part 1. Before its fastening, the bearing part 1 is loaded by two spring elements 4, 5, each designed as a pressure spring, in the transverse vehicle direction toward a lateral area of the closed tailgate, against which the clamping element 3 is resting when the tailgate is closed, and thereby prevents transverse movements of the tailgate possibly connected with disturbing noise.

In the embodiment, the bearing part 1 can be fastened to the corresponding tailgate or to the corresponding wall area 2 of the vehicle body from the outside and/or the inside of the vehicle, when the tailgate is open and/or closed.

The clamping element 3 has a run-on slope or curvature 6. This slope or curvature at least indirectly interacts with the tailgate during the closing of the tailgate when the bearing part 1 is not fastened. This causes an automatic displacement of the bearing part 1 in a fastening position, in which the tailgate can be adjusted into its closing position.

In the embodiment, the bearing part 1 is detachably fastened to a supporting element 7 fixedly or detachably connected with the vehicle body and illustrated in FIG. 1, and can be automatically adjusted in its position before a fastening in the transverse direction of the vehicle. The two pretensioned spring elements 4, 5 are each at least indirectly supported on one side at the supporting element 7 and on the other side at the bearing part 1 and load the bearing part 1 in the transverse direction of the vehicle into the closing adjusting area of the opened tailgate.

Between the bearing part 1 and the supporting element 7, a detent device is frictionally and/or form-fitting effective, which prevents, after an adjusting of the bearing part 1 in the transverse direction of the vehicle from the opening adjusting area of the tailgate automatically caused by the closing of the tailgate against the pretensioning force of the spring elements 4, 5, that the bearing part 1 is adjusted back into a position at least partially relaxing the spring elements 4, when the tailgate is subsequently opened.

In the embodiment, the frictionally and/or form-fittingly effective detent device is formed by two toothing rows 8, 9 at the bearing part 1, in which, in each case, in a spring-elastic manner, a countertoothing 10, 11 engages at a spring arm 12, 13 which, in the present embodiment, is connected with the supporting element 7. The supporting element 7 which, in the embodiment, is designed in areas in an angular shape and in the fashion of a housing at an angle leg, largely surrounds the bearing part 1 except, for example, at an access opening. In the housing-type area of the supporting element 7, a guide, which is not visible in the figures, for the bearing part 1 is formed in the transverse direction of the vehicle.

During the mounting of the supporting device, for example, first the supporting element 7 together with the adjustably accommodated bearing part 1 and the clamping element situated in a premounting position, for example, when the tailgate is open, is fastened in a lateral rear area of the motor vehicle next to a rear opening closable by the tailgate. After the bearing part 1, not yet fastened, has been accommodated by the supporting element 7 in a restrictedly adjustable manner in the transverse direction of the vehicle, the pretensioned spring elements 4,5 have adjusted the bearing part 1 together with the clamping element 3 situated in the preclosing position into the closing adjusting area of the opened tailgate such that, during the subsequent closing of the tailgate, an area or a part of the tailgate interacting with the run-on slope or curvature 6 of the clamping element, can push the clamping element 3 together with the bearing part 1 against the pretensioning forces of the spring elements 4, 5 laterally into the housing-type area of the supporting element 7, and the tailgate can be completely closed. In the closed position of the tailgate, the clamping element 3 situated in the preclosing position will rest against a lateral area of the closed tailgate.

The detent device acting frictionally or form-fittingly between the bearing part 1 and the supporting element 7 does not prevent this adjusting movement of the bearing part 1. For this purpose, the relevant flanks of the toothing rows 8, 9 or countertoothings 10, 11 respectively of the detent device are designed to be correspondingly inclined such that, during this adjusting movement, the toothing rows 8, 9 and countertoothings 10, 11 briefly mutually lift out of each other (disengage from one another) and therefore do not have a locking effect.

However, the toothing rows 8, 9 and countertoothings 10, 11 of the detent device, which mutually engage by means of an elastic pretensioning force of the spring arms 12, 13 of the supporting element 7, prevent that the bearing part 1 and the clamping element 3 adjustably arranged on the bearing part 1 can adjust by means of the pretensioning forces of the two spring elements 4, 5 back into the closing adjusting area of the tailgate when the tailgate is subsequently opened.

Figure 2:
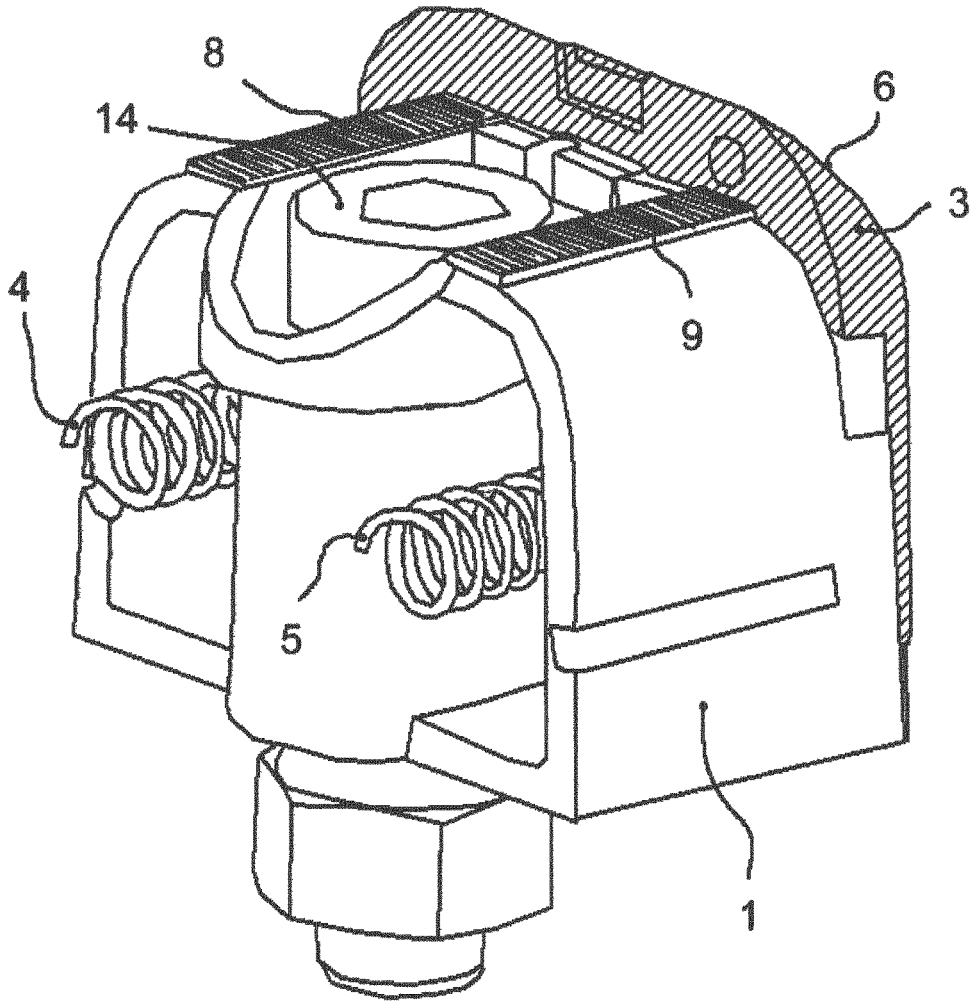
FIG. 2 is a simplified perspective view of the clamping element of the supporting device in FIG. 1, which clamping element is adjustably connected with an adjustable bearing part.
Figure 3:
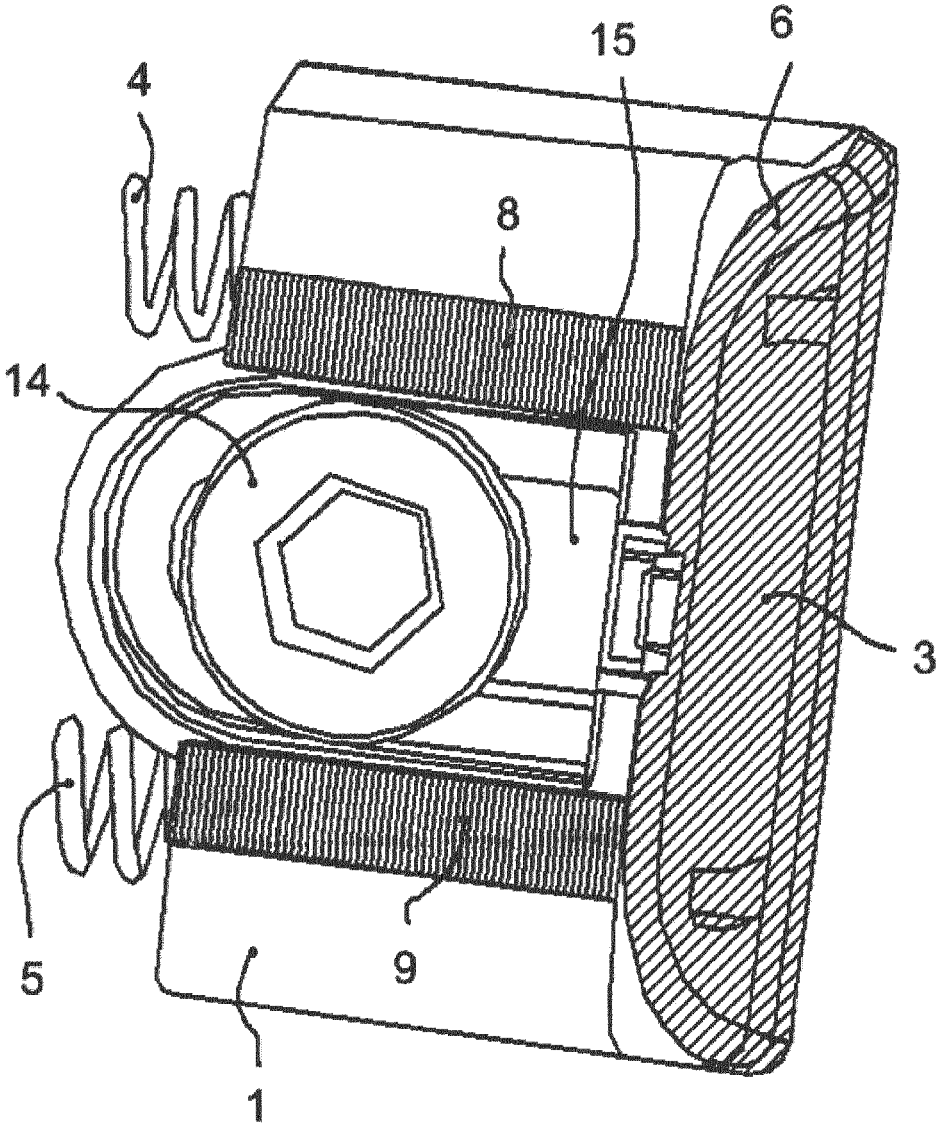
FIG. 3 is a top view of the parts of the supporting device illustrated in FIG. 2.

In the position of the bearing part 1 and of the clamping element 3 automatically adjusted by a closing of the tailgate, in the embodiment, the bearing part 1 can now be fastened by way of the screw 14 illustrated in FIGS. 1 to 3 to the wall area 2 of the vehicle body. In the present implementation, the screw 14 penetrates the through-opening in the supporting element 7 and an oblong through-hole 15 in the bearing part 1. In its length, the oblong hole 15 is dimensioned in one direction such that an end area of the oblong hole 15 interacting with the screw 14 limits the adjustability of the bearing part 1 when, during the mounting, the not yet fastened bearing part 1 together with the clamping 3 is adjusted into a position in the closing adjusting area of the tailgate in which, during the closing of the opened tailgate, an area or part of the tailgate, interacting with the run-on slope or curvature of the clamping part 3, adjusts the bearing part 1 and the clamping element 3 into a position, in which the tailgate can be closed. After such an adjusting of the bearing part 1, for fastening the bearing part 1, the screw 14 can be screwed into a fastening thread in the wall area 2 of the vehicle body or of a component arranged thereon. The screw 14 loads the supporting element 7 at least indirectly against the wall area 2 of the vehicle body and also fixedly clamps it.

In the embodiment, the clamping element 3 can be adjusted by way of a (not shown) wedge guide with respect to the bearing part 1 from the premounting position illustrated in FIG. 2 into the clamping position corresponding to the final installation position, in which case, during the adjusting from the premounting position into the clamping position, the clamping element 3 in the wedge guide frictionally wedges with respect to the bearing part 1. For this purpose, the wedge guide may, for example, at least in areas, have a slightly conical design.

According to FIG. 1, another supporting device is also fastened to the supporting element 7 connected with the wall area 2 of the vehicle body. This other supporting device, for example, has a form similar to that of the above-described supporting device. This other supporting device has another bearing part 1' which is also detachably and adjustably fastened to the supporting element 7. Another clamping element 3' is frictionally and/or form-fittingly adjustably connected with the other bearing part 1' such that, after a fastening of the other bearing part 1', whose position was previously adjusted, the other clamping element 3' can be adjusted either by an application of force from a premounting position into a clamping position limited by a stop, or in a different manner, from its premounting position into the clamping position. In the clamping position, the other clamping element 3' is frictionally and/or form-fittingly held on the other bearing part 1' and, when the tailgate is closed, rests under a pretensioning force at least indirectly against the tailgate.

While the above-described clamping element 3 causes a lateral support of the closed tailgate, the closed tailgate, which is held by at least one lock, is supported by the additional clamping element 3' in the closing direction and is, in this case, loaded in the direction of an open position. In addition to the clamping element 3 laterally supporting the closed tailgate, a further, (not shown) clamping element of a further supporting device is provided on the laterally opposite side of the tailgate. This additional supporting device supports the tailgate from the other side. The two lateral supporting devices may, for example, have identical constructions. In the driving operation of the motor vehicle, the supporting devices prevent the tailgate from possibly carrying out acoustically annoying movements or making contact with areas of the vehicle body away from the supporting devices. The area of the tailgate interacting with the respective clamping element 3, 3' may be formed by a separate component, for example, made of an elastomer, plastic or rubber, which, like the clamping elements 3, 3', is resistant to wear and/or has a damping effect.

The invention can naturally be implemented in a manner deviating from the single embodiment. The supporting device is provided for a closed flap of a vehicle. The flap may, for example, be a tailgate of a motor vehicle. A bearing part is arranged on the flap or on a wall area of the vehicle body adjacent to the closed flap, which bearing part can be adjusted in its position before its fastening. A clamping element is frictionally and/or form-fittingly adjustably connected in its premounting position with the bearing part in such a manner that, after the fastening of the bearing part previously adjusted in its position, the clamping element is adjustable by an application of force from the premounting position into a clamping position limited by a stop, in which the clamping element is frictionally and/or form-fittingly fixedly held at the bearing part and, when the flap is closed, rests at least indirectly under a pretensioning force against the flap or a wall area. The clamping element may, for example, be adjustable by way of a guiding device or swiveling device with respect to the bearing part or may be swivelable about a real or virtual stationary or mobile axis.

The bearing part is loaded by at least one spring element toward the closed flap or toward the wall area, against which the clamping element rests when the flap is closed. When the flap is open and/or closed, the bearing part is to be fastened from outside and/or inside the vehicle to the respective flap or to the respective wall area of the vehicle body.

The clamping element may have a run-up slope or curvature 6 which, during the closing of the flap when the bearing part is not fastened, interacting with the other component, with the flap or with the wall area, causes an automatic displacement of the bearing part into a fastening position, in which the flap can be adjusted into its closing position.

The bearing part may, for example, be detachably fastened to a supporting element fixedly or detachably connected with the vehicle body and, before the fastening, may be adjustable in its position in at least one direction. The at least one spring element can, for example, at least indirectly support itself on one side at the supporting element and on the other side at the bearing part.

A detent device may operate in a frictional and/or form-fitting manner, for example, between the bearing part and the supporting element, which detent element prevents, after an adjusting of the bearing part automatically caused by closing the flap against the pretensioning force of the spring element, that the pretensioned spring element adjusts the bearing part back into a position at least partially relaxing the spring element.

During the closing of the flap, the clamping element can interact with a face area or with a lateral area of the flap or with a wall area of the vehicle body that is adjacent to the face area or lateral area of the flap. The clamping element can arbitrarily, for example, by means of at least one wedge guide, be adjustable with respect to the bearing part from the premounting position into the clamping position. When a wedge guide is used, the clamping element can frictionally wedge in the wedge guide during the adjustment from the premounting position into the clamping position. The bearing part adjusted in its position may be fastened arbitrarily, for example, by way of at least one screw at least indirectly to the vehicle body or to the flap or, as required to the supporting element. When a supporting element is used, the bearing part (or additionally a further or another bearing part) is to be detachably and adjustably fastened to the supporting element and/or to the flap and or to a wall area of the vehicle body in an adjustable manner.

In a premounting position, a further or other clamping element may be connected with the further or other bearing part in a frictional and/or form-fitting manner such that, after a fastening of the further or other bearing part previously adjusted in its position, the further or other clamping part can be adjusted either by an application of force from its premounting position into a clamping position limited by a stop or in a different manner from its premounting position into the clamping position, in which the further or other clamping element is fixedly held in a frictional and/or form-fitting manner on the further or other bearing part and, when the flap is closed, rests at least indirectly under a pretensioning force against the flap or against another wall area of the vehicle body.

The clamping element can cause a lateral support or a support in the opening direction of the respective closed flap. In the case of an additional use of a further or other clamping element, the further or other clamping element can, for example, cause another support in the opening direction or a lateral support of the respective closed flap, that is similar to the clamping element, but in a different direction.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A support for a closed flap of a vehicle, comprising:

a bearing part arranged at the flap or a wall area of a vehicle body adjacent to the closed flap, said bearing part being configured so as to be adjustably positionable automatically via displacement occurring via interaction with the flap or wall area before being securely fastened to the flap or the wall area;

a clamping element adjustably connected in a premounting position thereof to the bearing part in a frictional or interlocking manner, wherein after the secure fastening of the bearing part which was previously adjusted into position, the clamping element is adjusted, via an applied force, from the premounting position into a clamping position limited by a stop, and in the clamping position, the clamping element is frictionally or interlockingly held in a non-displaceable manner at the bearing part and, at least indirectly, rests against the flap or the wall area under a pretensioning force when the flap is closed.

2. The support according to claim 1, wherein:

the clamping element is adjustable via a guiding device or a swiveling device with respect to the bearing part.

3. The support according to claim 1, wherein:

the clamping element is swivelable about an axis.

4. The support according to claim 1, wherein:

at least one spring element loads the bearing part, before the secure fastening of the bearing part, toward the closed flap or the wall area on which the clamping element rests at least indirectly when the flap is closed.

5. The support according to claim 1, wherein:

the bearing part is securely fastened on the flap or the respective wall area of the vehicle body from inside or outside the vehicle when the flap is open or closed.

6. The support according to claim 1, wherein:

the clamping element has a slope or curvature which, during closing of the flap when the bearing part is adjustably positioned before being fastened, interacts with the flap or wall area to cause the automatic displacement of the bearing part.

7. The support according to claim 4, further comprising:

a supporting element fixedly or detachably connected with the wall area of the vehicle body or with the flap, wherein the bearing part is adjustably fastened to the support element, and the bearing part being adjustable, before its secure fastening, in its position at least in one direction, and wherein the spring element is supported at least indirectly on one side at the supporting element and at another side at the bearing part.

8. The support according to claim 7, further comprising:

a detent, which acts frictionally or form-fittingly between the bearing part and the supporting element, said detent preventing, after an adjustment of the bearing part that is automatically caused by closing the flap against the pretensioning force of the spring element, the pretensioned spring element from adjusting the bearing part back into a position that at least partially relaxes the spring element.

9. The support according to claim 1, wherein:

during closing of the flap, the clamping element interacts at least indirectly with a face or lateral area of the flap or with a wall area of the vehicle body that is adjacent to the face area or lateral area of the flap.

10. The support according to claim 1, further comprising:

a wedge guide by which the clamping element is adjustable with respect to the bearing part from the premounting position into the clamping position, and during adjusting from the premounting position into the clamping position, the clamping element is frictionally wedged in the wedge guide.

11. The support according to claim 1, further comprising:

at least one screw by which the bearing part, when adjusted into position to be securely fastened, is securely fastened at least indirectly to the vehicle body or to the flap.

12. The support according to claim 7, further comprising:

at least one screw by which the bearing part, when adjusted into position to be securely fastened, is securely fastened at least indirectly to the supporting element.

13. The support according to claim 7, further comprising:

an additional bearing part detachably and adjustably fastened to the supporting element;

an additional clamping element frictionally or interlockingly adjustably connected with the additional bearing part, wherein after securely fastening the additional bearing part previously adjusted in position, the additional clamping element is adjusted either by an applied force from a premounting position into a clamping position limited by a stop, and when the flap is closed, the additional clamping element at least indirectly rests under a pretensioning against the flap or against the wall area of the vehicle body, and the clamping element causes a lateral support of the closed flap and the additional clamping element causes a further support in an opening direction of the closed flap.

* * * * *